United States Patent [19]

Iwanaga

[11] Patent Number: 4,508,334

[45] Date of Patent: Apr. 2, 1985

[54] SYSTEM FOR SEPARATING TRANSFER-PRINTING SHEET

[75] Inventor: Yoshiharu Iwanaga, Tokyo, Japan

[73] Assignee: Ricoh Company, Ltd., Japan

[21] Appl. No.: 446,679

[22] Filed: Dec. 3, 1982

[30] Foreign Application Priority Data

Dec. 7, 1981 [JP] Japan ..... 56-182384[U]

[51] Int. Cl.[3] ..... G03G 15/00

[52] U.S. Cl. ..... 271/308; 271/900; 355/3 BE

[58] Field of Search ..... 271/306, 307, 308, 204, 271/206, 277, DIG. 2; 198/654; 355/3 BE, 16

[56] References Cited

U.S. PATENT DOCUMENTS

| | | | |
|---|---|---|---|
| 746,124 | 12/1903 | Mosher | 271/307 |
| 1,238,561 | 8/1917 | Ohl | 271/204 X |
| 1,462,923 | 7/1923 | Stevens | 271/204 |
| 4,062,631 | 12/1977 | Ichikawa | 271/308 X |

*Primary Examiner*—Richard A. Schacher

*Attorney, Agent, or Firm*—Guy W. Shoup

[57] ABSTRACT

A system for separating a transfer-printing sheet from a photosensitive member in the form of an endless belt of a copying machine including a separating member located on the photosensitive member having a free end.

3 Claims, 7 Drawing Figures

SYSTEM FOR SEPARATING TRANSFER-PRINTING SHEET

FIELD OF THE INVENTION

This invention relates to systems for separating a transfer-printing sheet, and more particularly to a system for separating a transfer-printing sheet suitable for use in a copying apparatus wherein a transfer-printing sheet is superposed on an image formed on a photosensitive member to perform a transfer-printing operation and the transfer-printing sheet is separated from the photosensitive member to be ejected from the apparatus.

BRIEF DESCRIPTION OF THE DRAWINGS

FIG. 5(*b*) is side view of the essential portions of the embodiment shown in FIGS. 3 and 4 shown in another operating condition.

DESCRIPTION OF THE PRIOR ART

A system of the prior art for separating transfer-printing sheets will hereinafter be described by referring to FIGS. 1–2.

Figure 1:
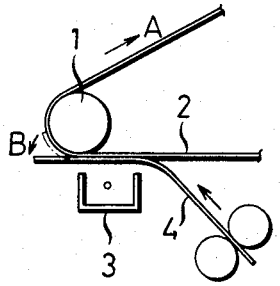
FIG. 1 PRIOR ART
FIG. 1 is a side view of one example of the system for separating transfer-printing sheet of the prior art.

In FIG. 1, a photosensitive belt 2 trained over a roller 1 of small diameter and another roller, not shown, moves in the direction indicated by an arrow A. A transfer-printing sheet 4 superposed on the photosensitive belt 2 and subjected to transfer-printing by the action of a transfer printing charger 3 is separated from the photosensitive belt 2 as indicated by an arrow B by its own firmness and on account of the acuteness of the angle formed by the runs of the belt 2 when the transfer-printing sheet 4 reaches a position corresponding to that of the small diameter roller 1. In this type of system of the prior art, separation of the transfer-printing sheet 4 from the photosensitive belt 2 has been effected by utilizing the high firmness of the sheet 4. Thus the prior art system has suffered the disadvantage that the system could not be applied to transfer-printing sheets of low firmness.

Figure 2:
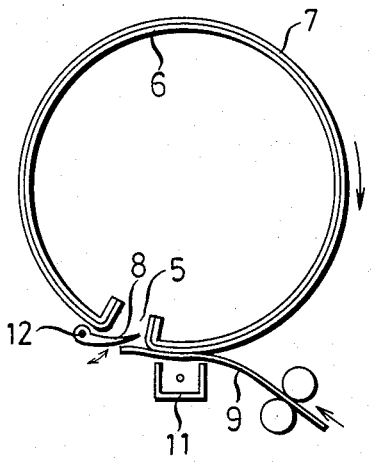
FIG. 2 PRIOR ART
FIG. 2 is a side view of another example of the system of the prior art.

As shown in FIG. 2, another system for separating transfer-printing sheets is known which comprises a drum 6 formed with a cutout 5 and having a photosensitive belt 7 trained over the outer periphery thereof, and a separating claw 8 located at an opening of the cutout 5. In this system, a transfer-printing sheet 9 is set on the photosensitive belt 7 in a manner to have a leading end of the sheet 9 located in the opening of the aforesaid cutout 5, and subjected to transfer-printing by the action of a transfer-printing charger 11. When the leading end of the sheet 9 subjected to transfer-printing moves together with the cutout 5 to a position corresponding to that of the claw 8, the separating claw 8 slightly moves about a pin 12 in pivotal movement and keep the forward end thereof in the cutout 5 for a very short period of time, before moving in an opposite direction to return to the original position. By virtue of the aforesaid reciprocatory movement of the separating claw 8, the transfer-printing sheet moves along the separating claw 8, to thereby enable separation of the sheet 9 from the photosensitive belt 7 to be achieved. However, in this system of the prior art, difficulties have been experienced in nicely timing the movement of the cutout 5 with the pivotal movement of the separating claw 8. This has often caused the separating claw 8 to impinge on the drum 6, resulting in rupture of the separating claw 8. Once the separating claw 8 is ruptured, it would become impossible to normally continue the separation operation. Furthermore, in bringing the separating claw 8 into contact with the transfer-printing sheet 9, some ingenious proposal has to be made to avoid trouble. If the aforesaid contact of the claw 8 with the sheet 9 is made improperly, proper separation of the sheet 9 from the belt 7 could not be effected.

SUMMARY OF THE INVENTION

This invention has been developed for the purpose of obviating the aforesaid disadvantages of the prior art. Accordingly the invention has as its object the provision of a system for separating transfer-printing sheets capable of separating a transfer-printing sheet positively from a photosensitive belt by a simple construction.

The aforesaid object can be accomplished by providing separating means having a free end located in a position on the photosensitive belt in which the leading end of a transfer-printing sheet is set. When the separating means approaches a position in which it is juxtaposed against a roller over which the photosensitive belt is trained or a position in which the photosensitive belt is curved, the free end of the separating means moves away from the roller. Thus if the leading end of the transfer-printing sheet is located on the separating means, the leading end of such sheet is forcedly separated from the photosensitive belt at such curved belt position, thereby enabling separation of the transfer-printing sheet from the photosensitive belt to be positively achieved.

DESCRIPTION OF THE PREFERRED EMBODIMENT

A preferred embodiment of the invention will be described by referring to FIGS. 3–6.

Figure 3:
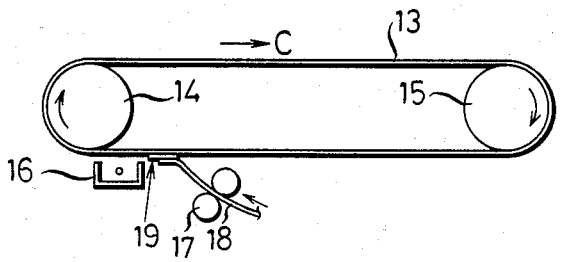
FIG. 3 is a side view of the system for separating transfer-printing sheets comprising one embodiment of the invention.

In FIG. 3, an endless photosensitive belt 13 is trained over rollers 14 and 15 and moves endlessly in a direction indicated by an arrow C, and has an image formed on its surface by means of an image forming device, not shown. A transfer-printing charger 16 is arranged beneath the one roller 14 supporting the photosensitive belt 13, and a transfer-printing sheet 18 fed at a predetermined timing by a pair of register rollers 17 is brought into superposing contact with the photosensitive belt 13. The transfer-printing sheet 18 is then subjected to transfer-printing by the action of the transfer-printing charger 16, so that the image formed on the photosensitive belt 13 is printed on the transfer-printing sheet 18. In this process, feeding of the transfer-printing sheet 18 by the register rollers 17 is timed such that the leading end of the transfer-printing sheet 18 being fed is in coincidence with the leading end of the image formed on the photosensitive belt 13. A separator 19 serving as separating means is mounted in a predetermined position (hereinafter transfer-printing sheet leading end set position on the photosensitive belt) in which the transfer-printing sheet 18 is set.

Figure 4:
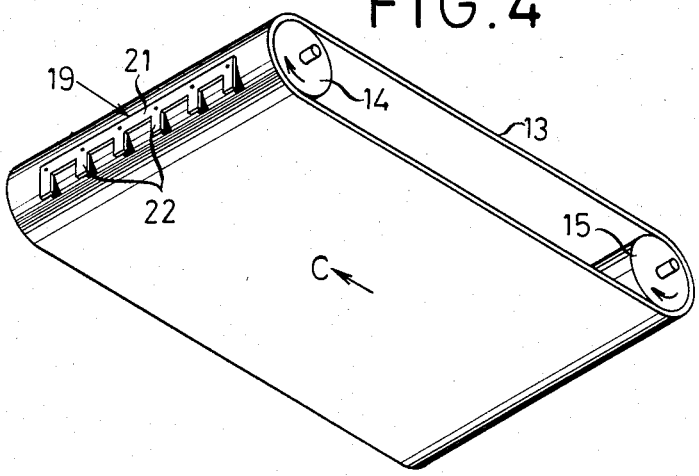
FIG. 4 is a perspective view of the photosensitive belt shown in FIG. 3, as seen from the bottom.

As shown in FIG. 4, the separator 19 is elongated widthwise of the photosensitive belt 13 and comprises two ends 21 and 22, one end 21 being located downstream of the other end 22 with respect to the direction of travel of the belt 13. The one end 21 is secured to the belt 13 while the other end 22 is a free end. When the photosensitive belt 13 moves, the separator 19 also moves. When the separator 19 is disposed on a flat run between the rollers 14 and 15, the free end 22 is kept in intimate contact with the surface of the photosensitive belt 13. However, when the separator 19 reaches a curved run of the belt 13 positioned against the roller 14 or 15, the free end 22 is moved away from the belt 13. The dimension of the separator 19 extending in the direction of movement of the belt 13 is set suitably in accordance with a blank region located at the leading end portion of an image region on the belt 13, so that the pressure of the separator 19 has no adverse effect on the image to be printed on a transfer-printing sheet.

Figure 5A:
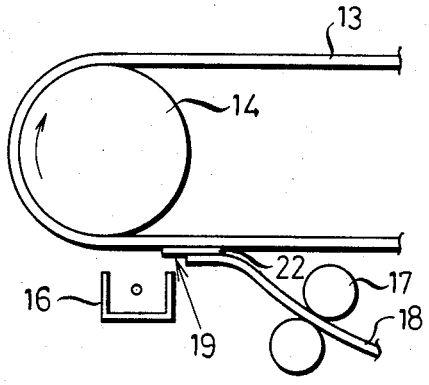
FIG. 5(*a*) is a side view of the essential portions of the embodiment shown in FIGS. 3–4, shown in one operating condition.
Figure 5B:
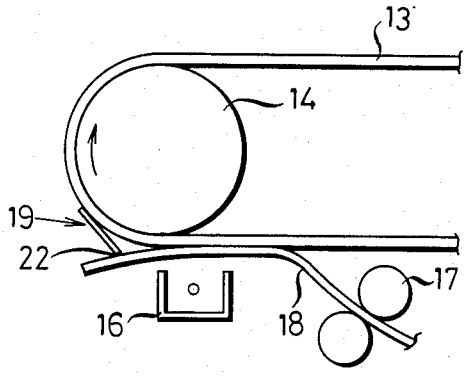
Figure 6:
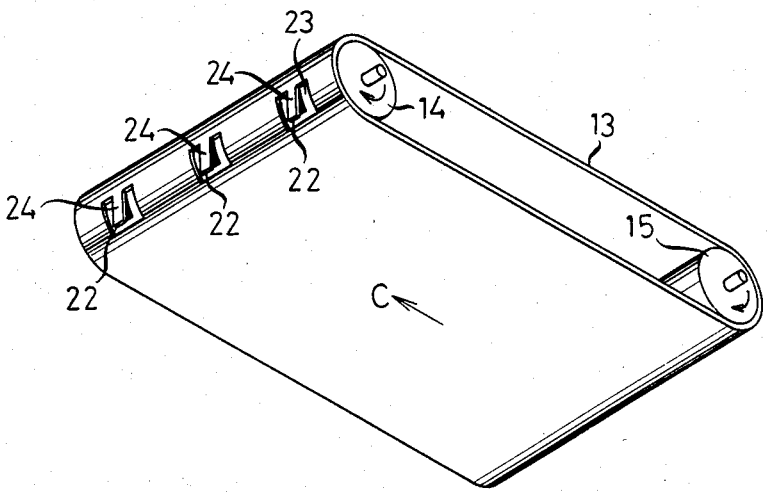
FIG. 6 is a perspective view of a modification of the photosensitive belt as seen from the bottom.

The transfer-printing sheet separating system according to the invention is constructed as aforesaid. It will be seen that the transfer-printing sheet 18 fed by the register rollers 17 is brought into superposing contact with the photosensitive belt 13 in a manner to bring the leading end of the sheet 18 into agreement with the separator 19, as shown in FIG. 5(*a*). Thus, the transfer-printing sheet 18 superposed on the photosensitive belt 13 moves along with the photosensitive belt 13 and reaches the curved run of the belt 13 corresponding to the roller 14, after being subjected to transfer-printing by the action of the transfer-printing charger 16. As shown in FIG. 5(*b*), the separator 19 extends tangentially of the roller 14 to thereby have the free end 22 moved away from the photosensitive belt 13. By virtue of this arrangement, the leading end of the transfer-printing sheet 18 coming into contact with the separator 19 is biased downwardly by the free end 22, so that the electrostatic force of attraction acting between the photosensitive belt 13 and the transfer-printing sheet 18 is weakened and separation of the transfer-printing sheet 18 can be positively achieved.

From the foregoing description, it will be appreciated that positive separation of the transfer-printing sheet 18 from the photosensitive belt 13 can be achieved by merely mounting the separator 19 in a predetermined position on the photosensitive belt 13. However, the invention is not limited to the specific form of separating means or the separator 19, and that a tongue 24 formed by providing the belt 13 with a cutout 23 in one portion thereof may be used as separating means.

What is claimed is:

1. In a copying apparatus comprising a photosensitive member in the form of a endless belt trained over a plurality of rollers for movement along a predetermined path for forming an image on a surface of said belt on which a transfer-printing sheet is superposed to print the image thereon, a system for separating the transfer-printing sheet from the photosensitive member and ejecting same from the copying apparatus following a transfer-printing operation, comprising:

separating means mounted on the surface of said photosensitive member in the form of an endless belt in a receiving position in which the separating means lies flush with said belt, said separating means having a free end which lies beneath a leading edge of the transfer-printing sheet in said receiving position.

2. A system for separating the transfer-printing sheet as claimed in claim 1, wherein said separating means comprises a separating member extending widthwise of said photosensitive member in the form of an endless belt, said separating means being firmly secured to said photosensitive member at one end portion thereof and having free end at the other end, said one end portion being located downstream of said other free end with respect to the direction of movement of said photosensitive member.

3. A system for separating the transfer-printing sheet as claimed in claim 1, wherein said separating means comprises a tongue formed by providing said photosensitive member in the form of an endless belt with a cutout at one portion thereof.

* * * * *